US006172344B1

(12) United States Patent
Gordon et al.

(10) Patent No.: US 6,172,344 B1
(45) **Date of Patent: *Jan. 9, 2001**

(54) ELECTRICALLY CONDUCTIVE MATERIALS

(75) Inventors: John Yeats Gordon, Clitheroe; John Robert Rix, Doncaster; Graham Gerrad, Lancashire, all of (GB)

(73) Assignee: Gorix Limited, Southport (GB)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/495,504

(22) PCT Filed: Dec. 16, 1994

(86) PCT No.: PCT/GB94/02751

§ 371 Date: Jul. 25, 1996

§ 102(e) Date: Jul. 25, 1996

(87) PCT Pub. No.: WO95/18517

PCT Pub. Date: Jul. 6, 1995

(30) Foreign Application Priority Data

Dec. 24, 1993 (GB) ..... 9326461
Jan. 14, 1994 (GB) ..... 9400617

(51) Int. Cl.[7] ..... H05B 3/34; H05B 1/02

(52) U.S. Cl. ..... 219/529; 219/545; 219/549; 219/497

(58) Field of Search ..... 219/528, 529, 219/543, 545, 548, 569, 202, 211, 212, 217, 490, 497

(56) References Cited

U.S. PATENT DOCUMENTS

| | | | | |
|---|---|---|---|---|
| 3,385,959 | * | 5/1968 | Ames | 219/549 |
| 3,679,871 | | 7/1972 | Evalds . | |
| 3,789,190 | * | 1/1974 | Orosy et al. | 219/497 |
| 3,878,362 | * | 4/1975 | Stinger | 219/528 |
| 4,149,066 | * | 4/1979 | Niibe | 219/549 |
| 4,320,286 | * | 3/1982 | Borrup | 219/549 |
| 4,546,238 | | 10/1985 | Ahs . | |
| 4,629,868 | * | 12/1986 | Svensson | 219/528 |
| 4,697,064 | * | 9/1987 | Altmann et al. | 219/217 |
| 4,813,738 | * | 3/1989 | Ito | 219/217 |
| 5,023,433 | * | 6/1991 | Gordon | 219/548 |
| 5,302,807 | * | 4/1994 | Zhao | 219/549 |
| 5,422,462 | * | 6/1995 | Kishimoto | 219/529 |

FOREIGN PATENT DOCUMENTS

| | | |
|---|---|---|
| 2104681 | 8/1972 | (DE) . |
| 4221455 | 1/1994 | (DE) . |
| 0 174 544 | 3/1986 | (EP) . |
| 0278139 | 8/1988 | (EP) . |
| 1229401 | 4/1971 | (GB) . |
| 1246343 | 9/1971 | (GB) . |
| 1283444 | 7/1972 | (GB) . |
| 1301101 | 12/1972 | (GB) . |
| 1552924 | 9/1979 | (GB) . |
| 2261822 | 6/1993 | (GB) . |
| 51-729 | 1/1976 | (JP) . |
| 8703158 | 5/1987 | (WO) . |

* cited by examiner

*Primary Examiner*—Sam Paik
(74) *Attorney, Agent, or Firm*—Woodard, Emhardt, Naughton, Moriarty & McNett

(57) ABSTRACT

A conductive element useable as a resistance heater comprises a carbonized fabric (12) which has electrical terminals (18, 20) connected thereto and is encapsulated in or sandwiched between layers of plastic insulating material. The element generally is flexible and can be embodied in for example blankets for animals, vehicle seats and clothing. It is preferably provided with an electrical control circuit for controlling the temperature to which the fabric heats.

30 Claims, 5 Drawing Sheets

ELECTRICALLY CONDUCTIVE MATERIALS

FIELD OF THE INVENTION

This invention relates to the provision of electrically conductive materials which are in sheet or web form.

These materials are particularly usable as resistance heaters, and in this connection they have extremely wide application insofar as they may be used for example in horticulture as sub-soil heating sheets, eliminating the need for expensive hot air cloches, they may be used as wrap around heaters for animals, they may be used as mat heaters for caravans and counters, and they may be used as substrates in seats in vehicles or the like. It will be understood that in general these materials have extremely wide application and the number of instances in which they can be used is far too numerous to mention here.

BACKGROUND OF THE INVENTION

The materials of the invention are preferably such as to be effective when driven by a relatively low voltage, in particular a voltage up to the order of 110 volts, 110 volts being the maximum in practice which is considered to be reasonably safe as far as electrocution of human beings is concerned. It is envisaged that the materials in future developments may be used with higher driving voltages e.g. 240 volts, but for the purposes of clarity of description and from a practical point of view, when reference is made hereinafter to low voltage it is intended to mean a voltage up to the order of 110 volts.

Sheet structures which are electrically conductive and constitute resistance heating waxes are of course known and an example is described in GB Patent Specification No 2261822A; other structures include textiles impregnated/coated with a carbon slurry and carbon fibers woven into a conductive mat. But, our investigations lead us to the belief that such structures generally, unless they are designed for specific applications and are specially constructed, fail to give even heating characteristics across their area, lack strength and/or are ineffective when driven by relatively low voltages. Furthermore, they do not provide flexible sheet structures which are robust and can withstand aggressive handling and can operate in damp and corrosive environments.

The present invention at least in its preferred form in meeting these requirements provides a considerable advance in low voltage resistance heating technology.

A main aspect of the invention resides in that a textile fabric of a particular type is used as an electrically conductive resistance heating element. The particular fabric which has been identified in this invention is one which in particular is a fabric containing synthetic material fibers, and in which the fabric has been subjected to a high temperature treatment in order to render the fabric fire and flame resistant.

Thus, a fabric made of polymeric fiber and baked in stages by heat treatments at high temperatures for a predetermined time has been produced for utilization in the past in relatively high tech applications. The baking of the fabric has the effect of carbonization of the polymer which is a process of formation of carbon in the fibers from the basic hydrocarbon material. As explained, this material has been produced in the past for high tech applications and in particular has been used in the nose cones of guided missiles, the purpose of the fabric being to make the nose cone highly heat resistant. The materials have also been used in other space technology applications again for heat and flame resistance. A third application is for the utilization of this material in the field of the formation of flame resistant wall structures.

The material has not heretofore been used as an electrical conductor, and indeed prior to the making of the present invention it had not been discovered that the material had excellent electrical conductivity properties and low resistance enabling conducting of relatively high currents at low voltage. The material when baked is in the nature of a fabric of a weight and consistency which may be compared to a typical textile furniture covering fabric, but it will usually be grey or black in color due to the carbonization of the polymeric material even if the fabric was not of such a dark color prior to the heat treatment.

Attaching bus bar conductors to such fabric at spaced locations, followed by the application of an electric potential between the bus bars has shown by experimentation that the fabric heats up evenly across the entire area of same, and the fabric furthermore efficiently converts the flowing electricity into resistance heat, even when relatively small driving voltages are applied. The possibilities for the utilization of such a material are endless.

The particular material which we have tested is a polyacrylonitrile based material of woven construction, although other materials and other structures such as knitted and other felted structures may be adopted. The heat treatment of the material was carried out in stages and involved baking at temperatures of 221° C. and 1000° C. respectively. According to preferred features of the invention, the carbonized fabric is sandwiched between protective layers in order to produce a flexible heating element. The sandwiching between the protective layers may leave the edges of the fabric exposed or may be such as to ensure that the fabric is encapsulated by the layers, which preferably render the entire flexible element waterproof and electrically contained.

The protective layers may be applied as coherent sheets to opposite sides of the fabric sheet followed by a laminating process involving either heat and pressure or glue and pressure, or alternatively either or both of the outer layers of the sandwich may be applied by a coating process involving the application of liquid coating materials which subsequently set firm either naturally or by the application of heat. Pressure preferably is also applied when coating materials are used, so that the coating materials will be able to flow through the interstices of the warp and weft of the fabric, it being remembered that a woven fabric is the preferred embodiment of the invention.

Any suitable flexible covering materials may be adopted and some examples are given hereinafter.

It is preferred that the resulting element be a tough flexible sheet structure which can either be formed in pieces or in a long length suitable for cutting into sections depending upon the application to which the section is to be put.

Preferably, bus bar connectors may be applied to the fabric before the coating or laminating takes place so that the bus bars will also be insulated by the laminates or coatings.

In one example, a continuous web of the fabric is fed in the direction of its length, and conductor strips are applied to the edges at both sides of the fabric, by a suitable adhesive or other bonding medium. Conductive strips may also be applied at any longitudinal position across the web in order to achieve a final mat size and electrical resistance appropriate for its final end usage. Additionally, for particular circumstances, conductive strips may be applied transversely across the width of the fabric. Coating materials are applied downstream of the application of the conductors in order to cover the fabric and conductors, and heat and pressure are applied in order to cure the coating layers as appropriate. There therefore results a continuous conductive web in which the fabric and the conductors are sandwiched between insulating layers. This web can then be cut transversely into lengths depending upon the application involved, and for each length, the resistance between the conductors increases as the length becomes shorter, and decreases as the length becomes longer. Therefore, by utilizing the sections in any desired pattern, e.g. by electrically connecting the sections in series, so the resistance of the resulting assembly can be varied and therefore the heating effect can be varied. When separate sections are coupled together they may be connected by means of electrical crimp terminals which are crimped through the encapsulation onto the conductors, but in this case it is preferable to use sealing tapes in order to seal or encapsulate the crimp connectors. Other forms of electrical connection (rather than crimp terminals) may be used. Also, the raw edges of the sections of the flexible element which are created by cutting the continuous web may be sealed by appropriate sealing tape or the like; in some applications this may not be necessary.

Although, as has been indicated herein, a major aspect of the present invention resides in the utilization of the particular carbonized fabric as an electrical conductor, with or without the encapsulation, the use of the encapsulation and conductive fabric presents another aspect of the invention, and in this aspect the conductive fabric may be any conductive fabric. Encapsulation again may be by laminating or coating.

By way of explanation of the main aspect of the invention, reference is now made to the accompanying diagrammatic drawings, wherein;—

Figure 8A:
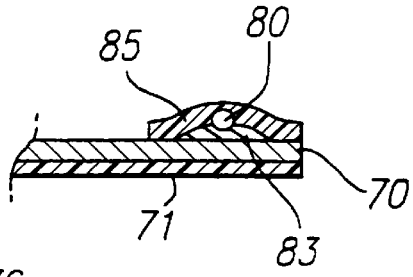
Figure 7:
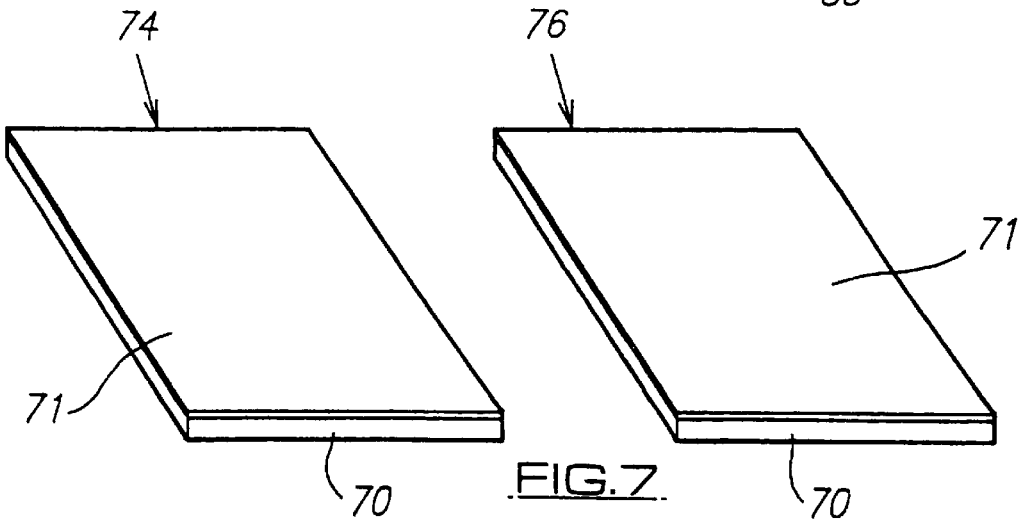
Figure 8:
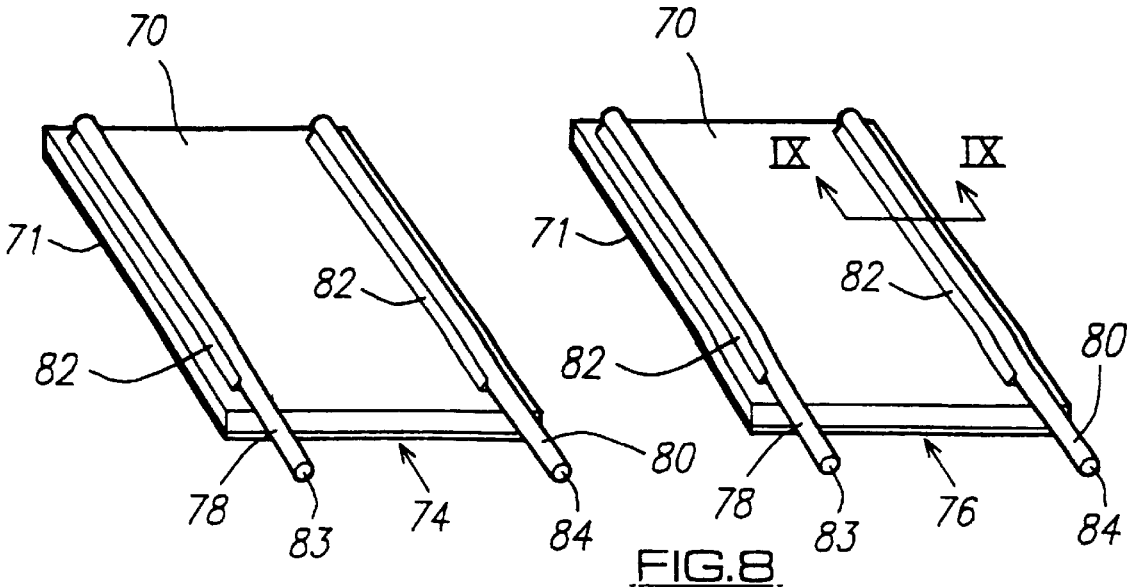
Figure 9:
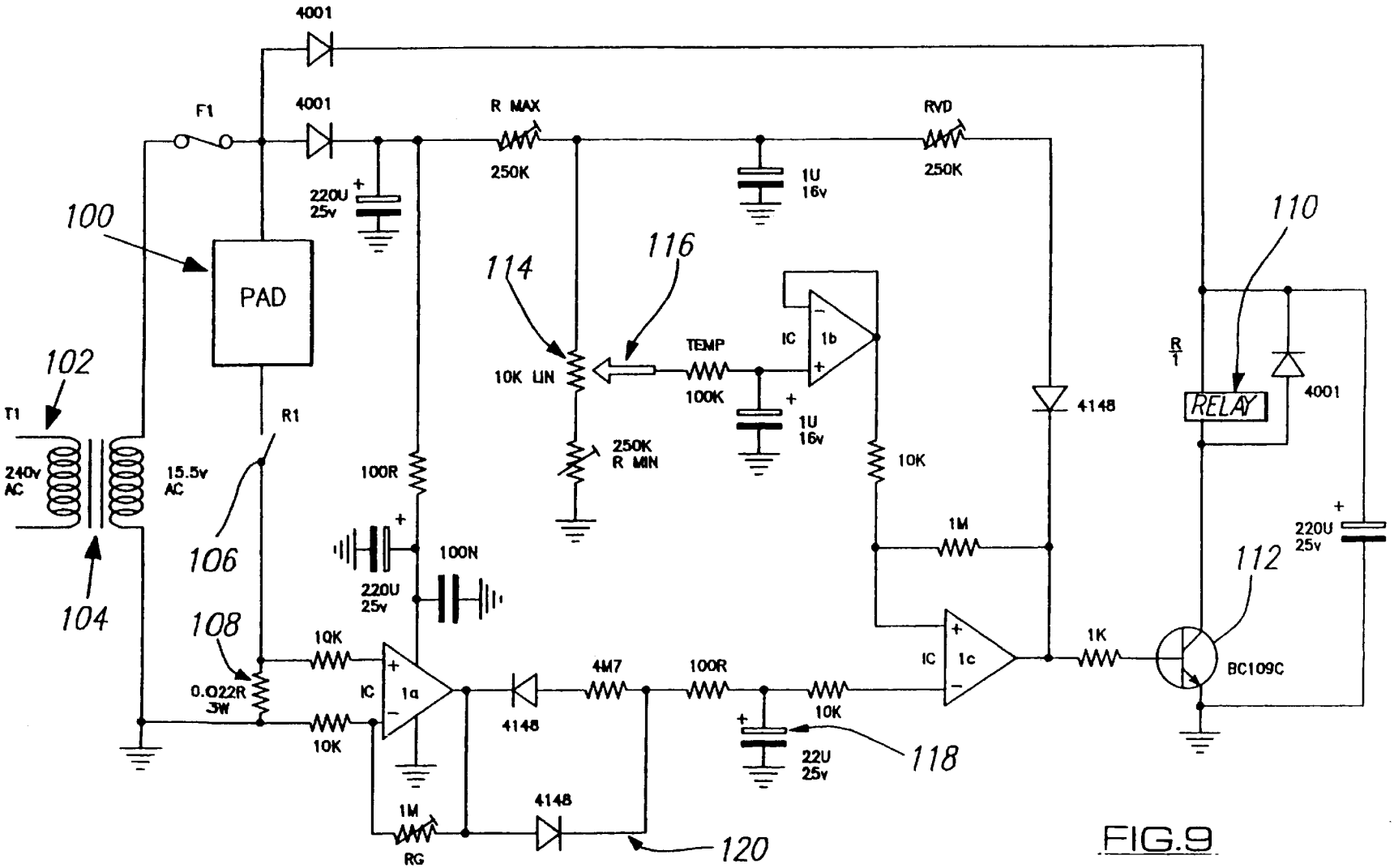
Figure 10:
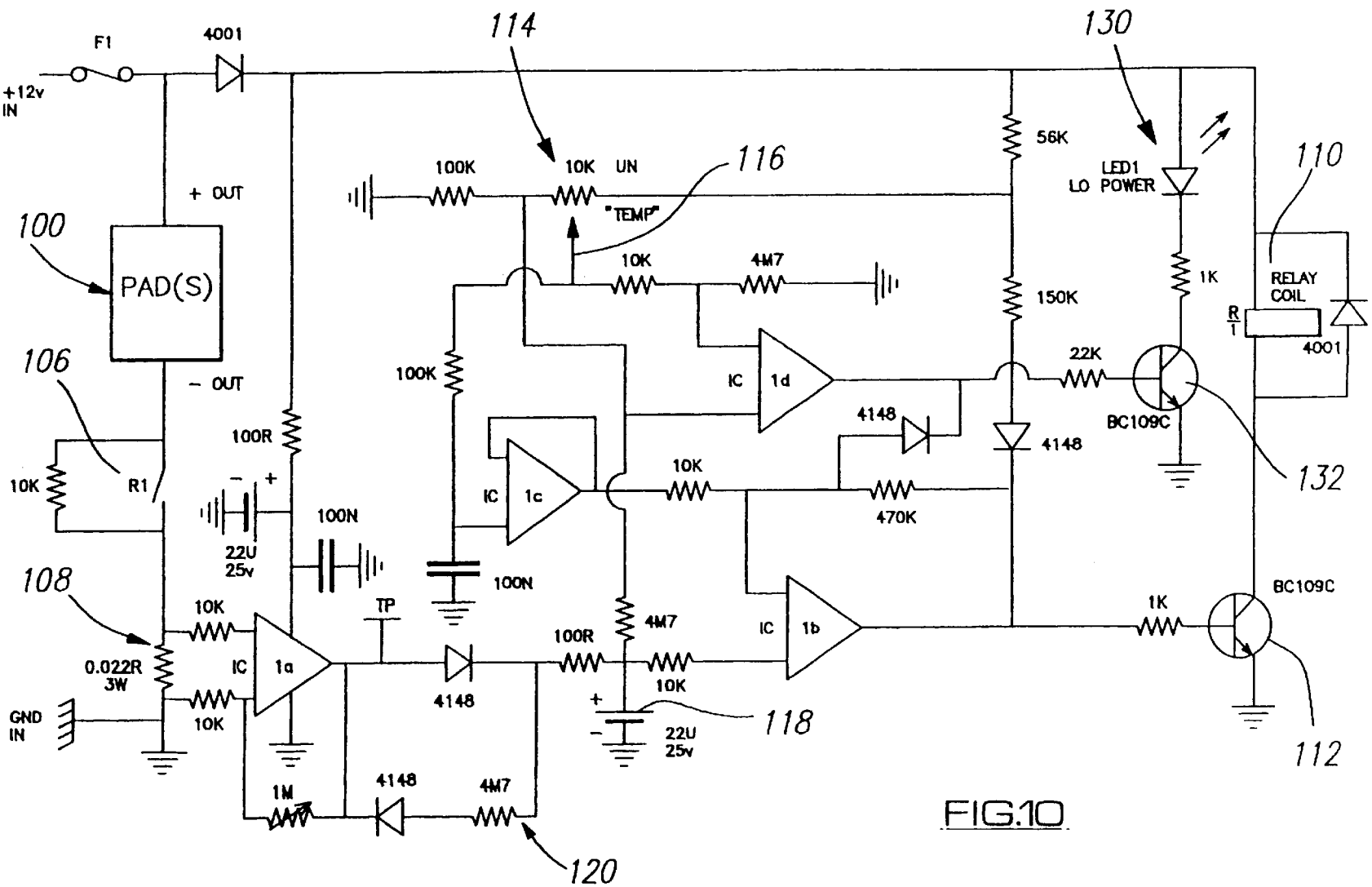

FIGS. 7, 8 and 8A are perspective views and a sectional elevation along the line IX—IX in FIG. 8 indicating the manufacture of heating elements for use in vehicle seats; and FIGS. 9 and 10 respectively are circuit diagrams showing electronic control arrangements for embodiments of the invention in the form of electric heating elements for horse blankets on the one hand, and vehicle seats on the other hand.

DESCRIPTION OF PREFERRED EMBODIMENTS

Figure 1:
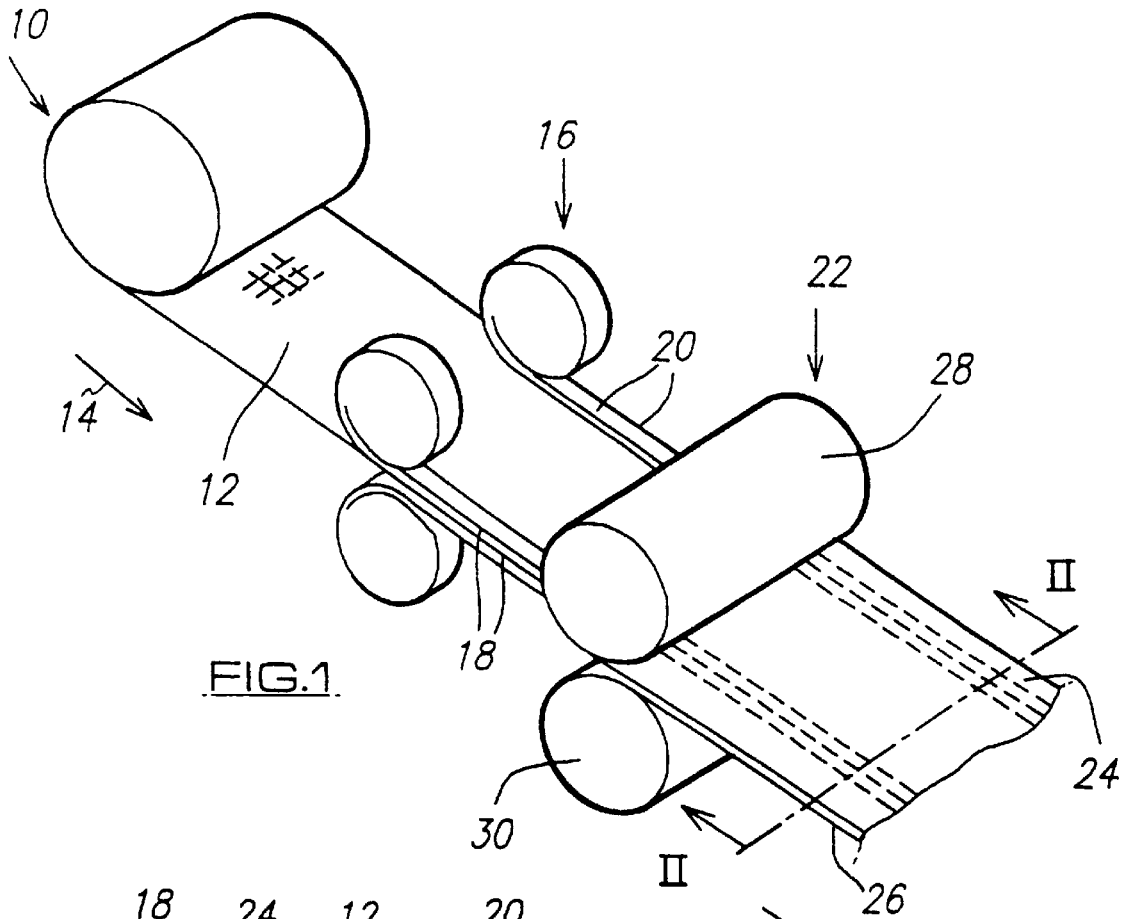
FIG. 1 is a perspective view showing one embodiment of how the flexible conductive resistance element is produced.

Referring firstly to FIG. 1, the carbonized fabric as described hereinbefore is illustrated as being in roll form by reference numeral 10, the fabric web itself being indicated by reference numeral 12. In the manufacturing process illustrated diagrammatically in FIG. 1, the web 12 is unwound from the roll 10 in the direction of arrow 14, and passes to a conductor application stage 16 at which conductive strips 18 and 20 are applied to the edges of the web 12 on both sides of the fabric web 12. Conductive strips may also be applied at any longitudinal position across the web in order to achieve a final mat size and electrical resistance appropriate for its final end usage. The conductive 18 and 20 which may be of copper foil or the like are applied by a suitable electrically conductive adhesive or bonding composition by any suitable means (not shown). The strips are shown on both sides of the fabric; they may be applied to one side only. As an alternative the conductive strips 18, 20 may be self adhesive and may have an adhesive applied on one side thereof, such side being applied to the fabric web 12. The conductive strips 18 and 20 are however sufficiently firmly connected to establish good electrical connection between the conductive strips 18 and 20 and the fabric web 12.

Reference numeral 22 illustrates a downstream station at which encapsulation is applied to the fabric web 12 and the conductive strips 18 and 20. Encapsulation in this case comprises webs 24 and 26 of a flexible plastics material which may be for example sheets of polyurethane coated nylon or other material. These encapsulation webs 24 and 26 are shown as being unrolled from supply rolls 28 and 30 located above and below the fabric web 12, and after application of the encapsulation webs 24 and 26 heat and pressure may be applied thereto in order to form sealed encapsulation around the fabric web 12 and the conductive strips 18 and 20.

Although in the example illustrated in FIG. 1, encapsulated webs 24 and 26 are indicated, in fact it is preferred that the encapsulation material be applied as fluent material coating, as a coating process is less expensive than a laminating process such as the one illustrated although the invention is intended to cover both processes.

Figure 2:
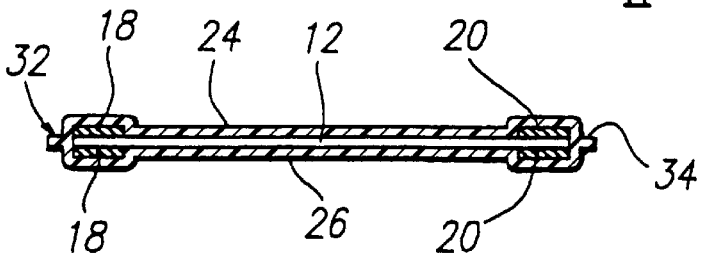
FIG. 2 is a cross sectional view to an enlarged scale, taken along the line II—II in FIG. 1.

FIG. 2 shows the finished web structure, and it will be seen that the fabric web 12 is encapsulated in the encapsulated layers 24 and 26 which are sealed together in the edge regions 32 and 34. The conductive strips 18 and 20 are also encapsulated by the encapsulation layers 24 and 26. The covering of the edge regions 32, 34 by encapsulation layers 24 and 26 is not essential. The edge regions 32, 24 of the fabric web 12 for some applications can be left exposed.

Figure 3:
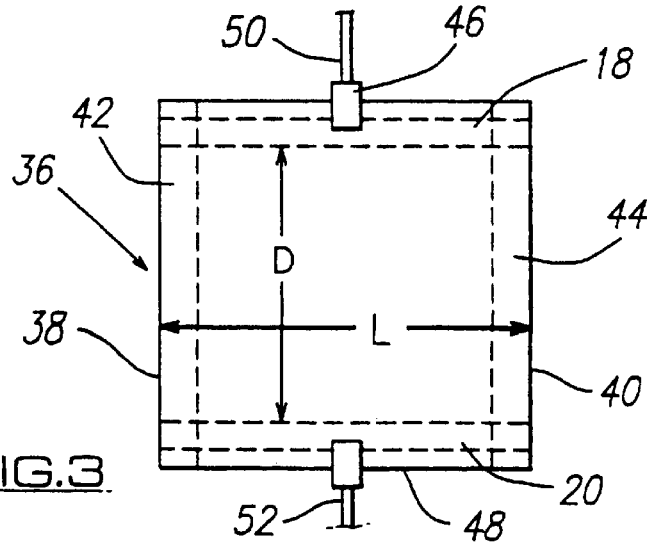
FIG. 3 is a plan view of a single element shown coupled to a voltage supply.

The material which is produced by the process of FIG. 1 may be rolled for storage, and cut to length depending upon required use, and by way of example in FIG. 3, a single length of the material forming one element 36 is shown. The cut edges 38 and 40 of the material are in this case sealed by means of tapes 42 and 44 which may be of the same material as the encapsulation layers 24 and 26, these tapes 42 and 44 being wrapped around and sealed over the cut edges (by a conventional hot air tape folding and sealing apparatus) in order to seal the same from moisture ingress.

To establish electrical connection with the encapsulated conductor strips 18 and 20, crimped terminals 46 and 48 are crimped onto the edges of the element to establish electrical connection between the conductive strips 18 and 20 and supply wires 50 and 52 between which a suitable low voltage electric potential is applied. Alternatively, the electrical connections may be made by lifting a portion of the covering layer to expose an end of the bus bar and by making the connection by soldering.

When the electric potential is applied, there will exist a potential gradient between the conductive strips 18 and 20 which, it has been found, by the use of the particular fabric described herein, is even across the entire area of the element so that there is even heating across the entire surface area of the element which provides considerable advantage as hereinbefore indicated.

If desired, the crimped terminals 46 and 48 may subsequently be encapsulated with sealing tape or the like depending upon the location in which the element 36 is to be used.

Figure 4:
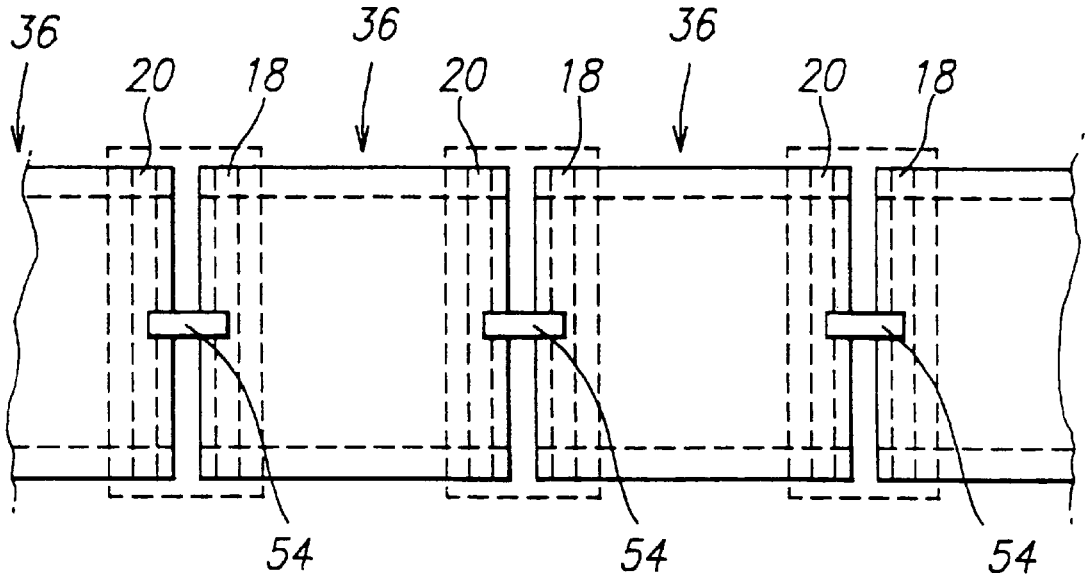
FIG. 4 shows several of the elements shown in FIG. 3 connected in series.

In this connection, FIG. 4 shows that several elements each such as 36 can be coupled in series with the conductive strips 18 of the elements 36 arranged adjacent the conductive strips 20 of the adjacent elements 36 and crimped connectors 54 are used to bridge elements and establish electrical connection therebetween via the conductive strips 18 and 20. Connecting the elements 36 as shown in FIG. 4 increases the resistance between the end terminals at which the potential is applied, whereby the heating characteristic of each element can be controlled. Any appropriate series or parallel arrangement of the elements 36 may be adopted depending upon the area and/or the shape of the article or surface to be heated.

The drawings illustrate of course only one embodiment of how the flexible electric resistance sheet structure may be constructed, and any other appropriate constructions and methods of construction may be adopted.

As will furthermore be understood, the heat which is generated by the material of the present invention will be governed by the voltage applied and/or the current which passes through the material. The current depends upon the resistance, and the resistance depends upon the distance D (see FIG. 3) between the conductive strips 18 and 20, and on the length L (also FIG. 3) of the element 36. These dimensions are of course under the control of the producer of the product.

It is desired that the resulting product should be flexible and yet robust, although this is not essential to the present invention.

The present invention provides that a conductive fabric which is encapsulated or sandwiched between protective layers can be produced by a quick, clean and simple method.

When the carbonized fabric is subjected to encapsulation by coating, it is preferred that a coating or a material such as polyurethane or P.V.C. for example in the range up to 800 $g/m^2$ is applied to both sides of the fabric in order to bond and seal the fibers of the carbonated fabric. Dependent upon the type of coating process being used it may be advantageous that a thin primer coating, of a similar material to the main coat, be applied on one side prior to the application of the bus bar (on the other side) and application of the main coating. This primer coat may be hot or cold rolled in its semi-liquid state in order to stabilize and reduce the porosity of the conductive web fabric before applying the main coat. The combination of applying the primer coat and/or main coat in a liquid state and subsequent application of pressure by rollers whilst in a semi-liquid state ensures that the coating(s) will pass through the weave structure of the carbonized fabric and upon cooling will fuse and form a cohesive unit with a coating on both sides.

When the carbonized fabric is subjected to encapsulation or covering by laminating, the carbonized fabric is sandwiched between layers or films of supported or unsupported P.V.C. or polyurethane or similar material. In the case of a supported material, the coated side shall be immediately adjacent to the carbonized fabric. The resulting sandwich can be subjected to heat and pressure. The heat may be achieved by any suitable means such as radiant heat or convection heat which serves to at least partially melt the coating to bring it to a liquid or semi-liquid state with the result that it will pass through the weave structure of the carbonized fabric and upon cooling will set and form a cohesive unit with the protective layers or films laminated to both sides. The pressure may be applied by a flat bed press or lattice type die or rollers or any other suitable pressing arrangement including one which forms the sheet into a contoured shape. This same laminating process may be employed with the additional step of applying an adhesive coat to adjacent faces of all layers to be laminated together.

An advantage of the arrangements described is that encapsulation is achieved by a dry process and an excellent bond is achieved between the outer layers of the sandwich by virtue of the fact that the semi-liquified polyurethane flows through and around the fabric of the sheet structure. When the coating material is cooled a water tight seal is achieved, and when the fabric is encapsulated the resulting product may be safe for use under water and in a wet or toxic environment.

It should be mentioned that any laminating or coating process may be adopted for the covering of the fabric 12. The concept of encapsulation of a conductive fabric is in itself an aspect of this invention, regardless of the fact that the fabric may or may not be of the particular type hereinbefore described which is a carbonized fabric.

Although polyurethane has been described as one coating material which can be used, other plastics material such as PVC or other polymer which melts under the action of heat can be used. The advantage of using a coating process, as opposed to a laminating process as described herein is that the coating process is much more attractive from an economical point of view.

Example of the Carbonized Fabric Production 1.5 denier polyacrylonitrile fibre tow of "carbon fibre grade", as supplied by Courtaulds is continuously baked in a baking oven at 221° C. (exactly) in a pure oxygen atmosphere for 10 hours, the tow being pulled therethrough at a rate of 5 m/minute. The ovens were of a type supplied by RK Carbon Fibres Inc of Philadelphia, USA. The baked tow is known as "oxidized polyacrylonitrile fiber" and after this baking the fiber was of the order of 60% carbon (or of the order of 60% carbonized). The treated fiber is then spun into yarn and woven using standard textile techniques and processes as follows.

1. Stretch Braked Process at a differential speed of 2.5
2. Drawn
3. Spun to 100 fibers in cross section
4. Twisted to 2/14 weight yarn
5. Woven to two meters wide; weight 330 $g/m^2$; ends 11.57/cm; picks 8.78/cm.

A second baking process is then carried out in an atmosphere of nitrogen or argon. The cloth was folded longitudinally in two so as to become one meter wide and baked in this condition. The cloth was carried through the oven on a conveyor belt, travelling at a speed of 70 meters/hour, the baking temperature being 1000° C. exactly. The fabric was relaxed in the weft direction and was restrained from end to end in the warp direction by feed and collection rollers regulated to maintain the speed of the fabric through the oven. The restraint can be from side to side with the fabric relaxed in the length direction. It can be restrained on relaxed in both directions. These alternative methods provide different resistance characteristics in the final fabric.

The finished cloth had a virtual 100% carbon content with a shrinkage across the width of 25% from 2 meters (opened out width) to 1.5 meters during the baking process.

The specific particulars of the fabric described above are as follows:

1. TOW

Color—White

Filament/Tow—320,000

Linear Density—1.67 d'tex

Linear Density of Tow—53.3 k Tex

2. TOW after first baking

Tensile—15.20 CN/Tex

Elongation—15%–25%

Density—1.38–1.4 gm/cm$^3$

Fiber Fineness—1.17–1.22 denier

Fiber Diameter—10–12 micron

Color—Black

Moisture Regain—8%

LOI—55%

Fiber Length (Top)—75 mm

3. YARN produced from 2 above.

| | |
|---|---|
| Composition | 100% Oxidized Polyacrylonitrile fiber |
| Linear Density | 2/14wc (127Tex) |
| Twist | 9.0 TPI Calculated 's'Direction (355 TPM) |
| Breaking Load | 1640 gms Nominal |
| Elongation | 12.3% Nominal |
| Levelness | 6.2% Nominal |

4. FABRIC woven from 3 above

| | |
|---|---|
| Appearance | Flat fabric |
| Colour | Black |
| Design | Plain weave |
| Width in loom | 84" |
| Ends per inch | 30 Nominal |
| Picks per inch | 22 Nominal |
| Finished Fabric weight | 270 g/m$^2$ Nominal |

5. CARBONISING treatment of 4 above

| | |
|---|---|
| Oven Temperature | 950° C. |
| Conditions | In Nitrogen Atmosphere Continuous Flow |

-continued

| | |
|---|---|
| Fabric Residence Time in oven approx | 14 mins |

6. FABRIC resulting from 5 above

| | |
|---|---|
| Carbonised Fabric weight | 240 gms/m$^2$ Nominal |
| Finished Width | 67" Nominal |

The electrical properties of the carbonized fabric (5) depend upon the weaving and baking parameters but typically, the fabric has an electrical resistance at 20° C. in the range 3.0 to 4.5 ohms per m$^2$ in the weft direction (across the width of the fabric) and 1.5 to 2.5 ohms per m$^2$ in the warp direction (along the length of the fabric). The electrical resistance reduces with temperature increase in a near linear manner. The reduction in electrical resistance is typically in the range of 0.4 to 0.7% per degree celcius and the tolerance to linearity within plus or minus 5%.

Advantages of the use of the fabric described in a heating element are that a) There is a relatively low surface temperature for a given heat output compared with wire elements which give local hot and cold areas b) the fabric, when laminated and/or encapsulated can be incorporated in a textile lay-up and cut out to any shape (for intended purpose) using conventional trimming techniques.

c) The low surface temperature permits the use of plastics material coatings.

Any appropriate carbonized fabric or any desired elemental configuration can be used in the present invention depending upon the heating characteristics required. Equally, any of various encapsulation and laminating methods may be adopted with appropriate encapsulation materials and some examples, physical properties and applications are given in the Table I. This is intended as a general guide and it may be that any one type of encapsulation may be used for end purposes other than those stated in Table I. Also, of the types of encapsulation and laminations listed, different ones may be used on different sides of the fabric.

TABLE I

| Category | Type of Encapsulation | Encapsulated Element Properties | End Use - Market |
|---|---|---|---|
| 1 | Direct PVC or Thermal PU Coating | Temp Range - 20°–100° C. Tough, Pliable, Antifungicide Voltage Range up to 110 Volts - AC/DC Waterproof | Horticulture, (Seed Propagation) Heated Shelving Therapeutic Pads (Animal & Human) Pet Heaters Heated Malting/ Carpets, Agriculture (Breeding Mats) |
| 2 | PU Coated Nylon or Polyester Lamination | Temp Range - 40°–130° C. Tough, Pliable, Waterproof Voltage Range up to 240 Volts AC | Specialist Markets where small quantities required: Specialist Heating, Racing Car Tyres Hypothermia Resusitation bags; Incubators; Invalid Car Rugs; Specialized Therapy |

TABLE I-continued

| Category | Type of Encapsulation | Encapsulated Element Properties | End Use - Market |
|---|---|---|---|
| 3 | Nylon/ Polyester Lamination From Square woven to knitted fabrics | Temp Range - 40°–130° C. Pliable, Breathable, Soft Voltage Range up to 40 Volts | Car Seat Therapeutic/Medical Invalid Chair Rug Survival Clothing Snow Mobile Suits Motor Bike Suits |
| 4 | Resin impregnated Fiberglass | Rigid, Waterproof, Strong, Easily Cleaned Temp Range - 20°–60° C. Voltage Range up to 240 Volts AC | Animal Husbandry Breeding Mats Industry |
| 5 | Rubber/Plastic Moulded | Waterproof, Flexible Easily Maintained Temp Range - 20°–50° C. Voltage Range up to 240 Volts AC | Breeding Mats |
| 6 | Foams, Closed Cell or Open, Coated or Uncoated | Temp Range - 20°–100° C. Soft & Pliable with "Non-Ruck" properties | Heated Blankets for Medical Market and Aged/Infirm Care |

The method of encapsulation coating or laminating can be any of various methods. To some extent the method will depend upon the materials used and the use to which the finished element will be put.

Thus, one can use a hot press for producing pads or sheets or a continuous process with hot rolls for continuous sheets, typically at a temperature in the range 160° to 180° to produce a sandwich comprising the carbonized fabric and thermoplastic and thermosetting binding layers or coatings such as nylon, polyurethane, PVC, polyester and laminates thereof, and there may be other finishing materials on the layers or coatings, such finishing materials including polyester, foam, nylon, plastics materials, to produce products such as those in categories 2 and 3 in Table I.

Any suitable hot press or hot roller arrangement may be adopted. Thus, for continuous lamination, the webs may be led round a large heated roller after being guided thereto by a pair of guide nip rollers whereat the webs are brought together, and as the laminated webs leave the heated roller they pass round a cold roller for the cooling of the webs to set them in laminated form.

In an alternative arrangement, the webs are fed continuously between the face to face reaches of two endless belts and to the other sides of the belts are heaters and pressure rollers for the hot pressing of the webs together.

For non-continuous lamination, standard hot, reciprocating press plates can be used.

Instead of using a plastic layer as the binding layer or coating a heat activated adhesive may be used, in which case the press or rolls temperature will be in the region of 100° to 150° C. Adhesive laminates can be used for producing products listed in categories 3 and 6 in Table I.

Specifically, adhesive netting such as the adhesive netting sold by PROTECNNIC of France under the trade name TEXIRON may be used in which case the temperature of the press or rolls preferably is in the range 70° to 130° C.

An encapsulation or coating layer, which can also serve as a binding layer to bind the carbonized fibers to the finishing material, may be applied by direct coating methods such as by hot knife wherein, for example a molten plastic of PVC, polyurethane or the like is doctored directly onto the carbonized fabric by means of a hot knife either by the knife deflecting the fabric as it travels between two guide rollers so that the knife and the web itself form a V-shaped trough in which a pool of the molten plastic is maintained, or the knife co-operates with a roller and although the web and knife again define a trough for the receipt of the pool of plastics material the roller in conjunction with the knife form a metering means. The products of category 1 of Table I can be produced by these methods.

A fiberglass mat impregnated with synthetic resin can be used as the binding coating or layer, and foam can be incorporated to assist insulation and to direct heat In one direction from the finished heating element. The resulting products may be those for example in category 4 of Table I.

Finally, the carbonized fabric may be encapsulated in the likes of rubber or plastic mat moundings, or laminations such as foam, PVC or rubber compound. The production of such products may involve injection moulding, casting, float moulding or adhesion or sheet lamination, and the resulting products may include those for example in category 5.

The preferred method for any particular product will be the one which takes best account of price; working/operational temperature range; strength and flexibility; launderability; and breathability.

The electrical connections to the carbonized fabric may be made in any suitable manner. The arrangement disclosed herein involves the application of bus bars to the fabric as indicated in FIG. 1.

The bus bar may be of copper or other electrically conductive metal foil, strip or woven wire braid, moulded conductive plastics conductors and it may be electrically conductive coated to reduce oxidation and other forms of corrosion.

Conductive plastics or silicone elastomers may be used as cements for the conductive bus bars which may also be sewn onto the carbonized fabric.

As to the methods of attachment, the bus bar is attached directly to the carbonized fabric. It may be sewn into place with a straight or preferably a multiple step zig zag stitch as the latter gives better electrical contact.

Alternatively or additionally, the bus bar can be laid on either a double sided, electrically conductive self adhesive tape or on an electrically conductive silicone elastomer or caulk. The double sided tape is better for applying a metal foil or strip bus bar, whilst the elastomer or caulk is better for the woven braid bus bar.

To enhance the electrical contact between the bus bar and carbonized fabric a hot air adhesive coat or plastic melt tape may be sewn over the bus bar. This helps to keep the bus bar in place and reduces electrical breakdown under stress and the possibility of corrosion. As an alternative to this form of protection non-conductive plastic or other compound may be directly extruded or moulded over the affixed bus bar.

Where conductive wires are sewn along the carbonized fabric electrical contact and protection against corrosion can be enhanced by the methods described above.

SPECIFIC PRODUCTS FOR SPECIFIC USES

1. Animal Blankets

Figure 5:
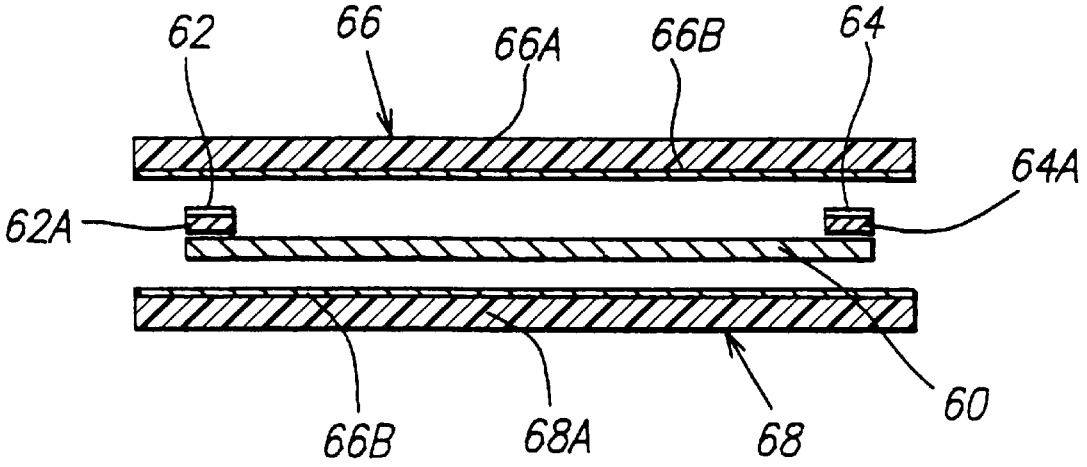
FIG. 5 is an exploded sectional elevation showing the respective layers of a specific product namely a heating element for an electric blanket for horses.

FIG. 5 shows the basic elements and layers of the material used for producing the thermal blanket for horses. A piece 60 of the carbonized fabric initially has the bus bar metal strips 62, 64 applied in a press by hot melt adhesive 62A, 64A, which in this example is type ST 12 sold by Rossendale in combination with heat and pressure. Next, the encasing layers 66, 68 are applied, again in the press under heat and pressure and each layer comprises a layer 66A, 68A of 30 denier knitted yarn coated on one side with polyurethane 66B, 68B. The layers 66, 68 are applied to opposite sides of the fabric (at a temperature of 80°–130°) so that the polyurethane layers 66B, 68B are innermost and are applied to opposite sides of the fabric 60 and, where the layers 66, 68 overlap the fabric layer, to each other. Electrical connections were made using crimp terminals.

The electric horse blankets produced are of benefit in applying heat for the treatment of soft tissue, muscular injury and strain. The blankets are intrinsically safe in in that they are driven by low voltage.

The carbonized fabric is sandwiched between layers (which may be any others of those described herein) to encourage heat produced by the fabric to travel in one direction rather than radiating away from the animal. The animal's own infra-red radiation is turned back towards its body by the sandwich thus ensuring both active and passive radiation are concentrated on the required anatomical area.

Several blankets were produced. The main blanket was a full size horse rug with carbonized fabric elements arranged to cover the four anatomic quarters of the animal. Additional electric blankets for the neck and spinal region and four electric leggings provided a total of nine separate electric therapy zones capable of being electrically heated. A separate control system was provided so that the individual zone could be operated selectively by means of a key pad. The blankets performed well and provided general advantages and specific advantages over conventional electric blankets for horses.

General advantages

1) Flexible
2) Portable and transportable
3) Uniform heat profile
4) Efficient
5) Low energy requirement
6) Safe, waterproof
7) Maintenance free
8) Cost effective Specific advantages over conventional electric blankets for horses A conventional electric blanket for a horse embodies a heating wire system in which the necessary spaces between the wires are in the order of 10 to 30 nm, resulting in high temperatures along the wires and large temperature gradients between the wires. The blankets using carbonized fabric have a much more uniform temperature distribution, typically within 1°to 3° C. over virtually any area.

Also, the wires in the conventional system must be insulated from the animal, resulting in an increase in temperature gradient between each wire and the animal, which increases heat loss from the blanket at the side remote from the animal. The blankets using carbonized cloth can be placed with the carbonized cloth very close to the animal.

Finally, carbonized fabric can be cut and punctured with much less risk of loss of performance whereas cuts and punctures in wires cause failure of the conventional blanket.

Similar products which have been made from the materials described in FIG. 5 are pads for tailor's dummies for the testing of thermal conductivity and insulation properties of clothing, and tire warmer blankets for heating racing car tires.

2. Car Seat Warmers

Figure 6:
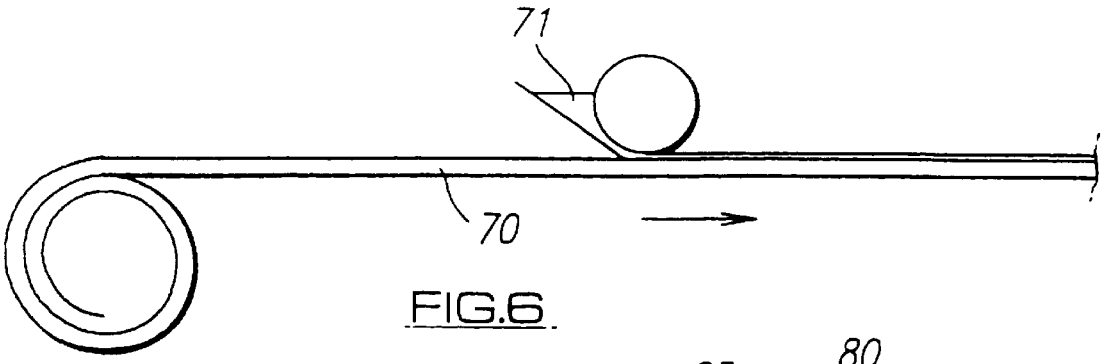
FIG. 6 is a side view indicating how a layer of the carbonized fabric is coated on one side.

Base material to provide car seat warming pads was produced by coating one side of a roll of the carbonized fabric 70 as shown in FIG. 6 with molten polyurethane 71 in a weight in the order of 400 g/m$^2$. No bus bars are applied at this time. The material is allowed to cool and then the required seat squarb and back pads 74, 76 are cut from the laminate as shown in FIG. 7. Next, the bus bars 78, 80 are applied to the uncoated side of fabric 70 using a carbon laden silicone cement 82 as shown in FIG. 8, the silicone cement being applied by an appropriate nozzle. The bus bars 78, 80 were of wire braid and extend beyond the pads to provide electrical connectors 83, 84. The connectors are further connected to the laminate by sewing as described herein.

Next, the wire braid bus bars 78, 80 are covered by polyester tape 85 coated with hot melt adhesive as shown in FIG. 8A and the element is then encapsulated completely in a pair of layers similar to layers 66, 68 shown in FIG. 5, with the connectors 83, 84 extending beyond the layers for connection to an electrical supply.

3. Medical Blanket

A basic material produced as shown in FIG. 6 is cut to provide individual pads of size 1.5 metre by 0.75 metre. Bus bars were applied along the longer sides as in the car seat example described above and then to the uncoated side was applied by a heat press an open cell PVC foam layer of similar size, the foam being 3 mm thick (type 85D sold by VITA PLASTICS of Salford, England).

The P.V.C. foam was coated on one side with a film of silver nitrite P.V.C. The other side of the foam had applied thereto a layer of the ST 12 Rossendale combining adhesive. The final composite was laminated by heating in a press for 5 to 7 seconds at a temperature of 110° C. 30 mm wide P.V.C. adhesive coated tapes are applied to the edges of the element by a tape folding, heating and seating machine.

As will be appreciated, the heating elements according to the invention can be associated with electrical control systems in order that the element will function in an appropriate, controlled manner. Thus, it is provided that the heater is thermostatically controlled. The heating element may therefore be associated with an electrical supply and an electrical control system which is temperature controlled in that the temperature of the blanket is automatically maintained at a pre-set temperature. The pre-set temperature is preferably adjustable.

Two specific embodiments of electronic control circuits are indicated in FIGS. 9 and 10 respectively. In these figures, the electrical components are indicated by conventional labelling and illustration, and various electrical values are indicated. These are obviously given by way of example and may be varied to suit the particular application. Also, the various electronic components may be housed in a single control box electrically coupled to the heating element which is indicated in each of the drawings by a pad or pads 100, such pad or pads 100 including or comprising the carbonized fabric as referred to herein.

Referring firstly to FIG. 9, the electronic control circuit is suitable for controlling the heating of a pad 100 which is in the form of an electric blanket according to the invention. The electrical supply is indicated by reference 102 and typically will be a 240 volts AC supply which is coupled to the circuit via a step down transformer 104 which provides an output of 15.5 volts AC.

The output voltage is applied across the pad 100 as shown, and the pad 100 is in series with a relay switch 106 and a current sensing transistor 108.

The relay switch 106 is operated by a relay 110 which is in series with a switching transistor 112 to control the switching on and off of the relay 110.

The circuit embodies a quad operational amplifier arrangement which uses three of the four amplifiers 1*a,* 1*b* and 1*c* as shown.

A potentiometer arrangement 114 is adopted for setting the temperature to which the pad 100 is to be heated and to which it is to be thermostatically controlled. The sliding pointer 116 of the potentiometer can be moved between a "hot" position designated by letter H and a "cold" position designated by letter C. The output of the pointer 116 is to the operational amplifier 1*b* and this in turn is coupled to the operational amplifier 1*c* set as a comparator switching device for controlling the transistor 112.

The output across the current sensing resistor 108 is coupled to the third operational amplifier 1*a* to control the operation of same, and the output of operational amplifier 1*a* is connected to an RC circuit including capacitor 118 and a diode/resistor circuit 120, the purpose of which will be explained hereinafter.

The above are the basic control elements of the circuit. No specific description is given of the other components illustrated although these will perform their normal function.

For the operation of the circuit of FIG. 9, assume that when the power is not coupled to the circuit and in this connection the relay 110 will be de-energized and switch 106 will be open. When the power is coupled, by means of a control switch (not shown) a potential is applied across the potentiometer 114, and depending upon the position of the pointer 116, a particular voltage will be applied via the pointer 116 to the amplifier 1*b.* This will provide an output from amplifier 1*b* which is supplied to the input of amplifier 1*c* which in turn provides an output to the transistor 112 which switches to cause the relay 110 to switch on. The relay then closes the switch 106, and the pad 100 becomes energized. Initially, because the pad is relatively cold, its resistance is high and therefore only a small current will flow therethrough. Thus, a small current flows through the current sensing resistor 108 which provides only a small potential drop across the current sensing resistor 108 which gives a correspondingly low output from the operational amplifier 1*a.* The pad 100 therefore commences heating. As soon as the pad 100 reaches its operational temperature, the voltage drop across the current sensing resistor 108 will be such as to cause an output from the operational amplifier 1*a* which in turn provides an output on amplifier 1*c* and as soon as that output becomes greater than the signal on the other input terminal of the operational amplifier 1*c,* the output from amplifier 1*c* is lost and transistor 112 switches off in turn causing the relay 110 to drop out. Switch 106 opens, and the voltage drop across current sensing resistor 108 disappears. The voltage from the RC circuit 118/20 however does not immediately disappear with the input of the operational amplifier 1*c,* but rather the RC circuit 118/120 causes a gradual decay as the capacitor 118 discharges and the voltage input to the operational amplifier 1*c* drops slowly. When it drops below the input to the other terminal of the operation amplifier 1*c,* the transistor 112 is again switched on and the relay 110 again is active which in turn brings the switch 106 to the closed position, and power is again supplied to the pad 100 to again heat the same. The system therefore is self equalizing, and an even temperature of the pad 100 is maintained. This temperature is set by the pointer 116 and in this connection it should be mentioned that this temperature could be fixed, and which case it would not be necessary to provide the potentiometer 114, but simply a voltage divider. The advantage of this arrangement is that it is the current through the pad 100 which forms the control means in providing the voltage drop across the current sensing resistor 108, and no temperature sensing is required. The circuit ensures that the temperature can be maintained despite any variation in the input voltage. The relay 110/106 may be an appropriate electronic switching device such as a triac or a power MOSFET. The whole circuit performs the task of driving current through the pad 100 at intervals as appropriate.

In the arrangement of FIG. 10, the drive voltage is 12 volts DC, and the circuit which is for a heater panel for a vehicle seat, includes an additional circuit containing an LED 130 for showing the user of the seat that power is being supplied to the pad heating element 100. The circuit includes many of the same components as the circuit of FIG. 9 and operates generally in a similar fashion and therefore much of the operation of the FIG. 9 circuit is not repeated in the description of the operation of FIG. 10. However, four operational amplifiers are used in this circuit, amplifier 1*d* being used to control an extra transistor 132 which is in series with the LED 130. Again, current sensing resistor 106 is used as the switching control means and transistor 112 is the switching device in series with the relay 110.

Again, the temperature to which the pad 100 heats is controlled by the potentiometer 114 and its pointer 116, but additional circuitry coupled to the amplifier 1*d* provides that when the pointer 116 is in the lowest or coldest position, there is a trickle current to the base of transistor 132 so that LED 130 conducts on such a level such that the LED 130 is illuminated with a low or dimmed illumination, indicating the heat off condition. When the user however positions the slider or pointer 116 to the desired position for heating the vehicle seat, the biasing on amplifier 1*d* changes, and transistor 132 conducts to such an extent to bring the LED 130 into illuminating with greater power, to cause it to glow to a much higher intensity. With this positioning of the pointer 116, which provides the switching on of the circuit (no separate switch being provided), the output of amplifier 1*c* is raised to bias amplifier 1*b* to cause transistor 112 to switch on. This brings on relay 110 which again closes the switch 106 to cause current to flow through the pad as previously described. Heating takes place as described in relation to FIG. 9, and the transistor 112 is switched off when the voltage at the other input of control transistor 1*b* exceeds that from 1*c* which causes transistor 112 to cease conducting, and relay 110 to drop out, switch 106 is opened, and power to the pad 106 is cut off. Capacitor 118 discharges slowly through the RC circuit as described, until the voltage at 1*b* from amplifier 1*a* is less than that from 1*c,* when a transistor 112 again switches on and pulls in relay 110. This in turn closes switch 106, and heating is recommenced.

It has been mentioned hereinbefore that the product has wide application for example in the horticultural industry where low temperature, high surface area heaters are required. The invention also can be applied in car seats, for industrial mats, in establishments involving counter sales where localized heat is required, and in applications such as boats, caravans and for heated mats of various types.

A particular feature of the invention is the utilization of a fabric which was created for a high technology application for its flame resistant qualities insofar as such a fabric has been shown to have excellent electrical conductivity characteristics when driven by low voltages giving the material a wide range of general industrial uses. The heating characteristics furthermore can be varied and adjusted by variation in the weft and warp specification where the fabric is of a woven type. There is relatively low surface temperature for a given heat output compared with wire elements, which give local hot and cold areas. This low surface temperature permits the use of plastics coatings and layers.

We claim:

1. An electrically conductive resistance heating system, comprising:

a carbonised fabric heating element having a characteristic that as the temperature of said carbonised fabric heating element increases, the resistance of said carbonised fabric element decreases;

means for applying a potential difference across said carbonised fabric heating element, and an electrical control circuit arranged to control the temperature of said carbonised fabric heating element, and to derive a control signal from an electrical current passing through said carbonised fabric heating element, said electrical control circuit further comprising comparative switching means first and second inputs and acting to selectively apply and remove said potential difference across said carbonised fabric heating element;

wherein said electrical control circuit further comprises:

thermostat means having an output, said comparator switching means receiving at the first input the output of said thermostat means and at a second input either the control signal when the potential difference is being applied across said carbonised fabric heating element or the output of a gradual decay circuit when the potential difference is not applied, said gradual decay circuit output being initially representative of said control signal but gradually decaying;

the operation of said comparator switch means being to apply the potential difference across said carbonised fabric heating element only when the first input signal is greater than the second input signal.

2. A heating system according to claim 1 wherein said electrical control circuit further comprises:

a current detecting circuit arrange to detect said current flowing through said heating element.

3. A heating system according to claim 2, wherein said current detecting circuit comprises a resistor.

4. A heating system according to claim 1, wherein said heating element includes a carbonised polyacrilonitrile woven fabric, said fabric being carbonised after being woven.

5. A heating system according to claim 1, wherein said comparator switching means includes a relay.

6. A heating system according to claim 1, wherein said thermostat means includes a potentiometer arranged to allow adjustment of the level of the output of said thermostat means.

7. A heating system according to claim 1, wherein said thermostat means includes a voltage device.

8. A heating system according to claim 1, wherein the electrical control circuit includes:

a resistor coupled in series with said carbonised fabric heating element;

a switch coupled between and in series with said resistor and said heating element;

a first amplifier coupled to said resistor, said first amplifier producing an output signal in accordance with a voltage across said resistor;

a source of reference voltage derived from said thermostat means;

a second amplifier coupled to said source of reference voltage and said first amplifier, said second amplifier producing an output signal in accordance with said reference voltage and said output of said first amplifier; and a transistor coupled to said second amplifier, said transistor controlling a state of said switch in accordance with said output of said second amplifier.

9. A heating system according to claim 8, wherein said thermostat means includes one of a potentiometer and a voltage divider.

10. A heating system according to claim 8, wherein said gradual decay circuit is coupled between said first amplifier and said second amplifier, said gradual decay circuit allowing for a gradual decay of said output of said first amplifier when said voltage across said resistor disappears.

11. A heating system according to claim 1, wherein said control circuit further includes an electronic circuit arranged to provide visual indication of a magnitude of said potential difference applied across said heating elements.

12. A heating system according to claim 11, wherein said electronic circuit includes an LED.

13. A heating system according to claim 1, wherein said heating element includes a polyacrilonitrile fabric, and said fabric is substantially 100% carbonised.

14. A heating system according to claim 1, wherein said heating element includes a woven fabric, and an electrical property of said fabric is determined at least in part by a selection of a wave parameter of said fabric.

15. A heating system according to claim 14, wherein said electrical property of said fabric is further determined at least in part by a selection of a carbonisation parameter of said fabric.

16. A heating system according to claim 14, wherein said electrical property of said fabric is determined at least in part by selectively restraining and relaxing said fabric in at least one of a weft direction and a warp direction during carbonisation of said fabric.

17. A heating system according to claim 1, wherein said means for applying a potential difference across said carbonised fabric heating element are electrodes connected to the element at spaced locations enabling the application of the potential difference across the area of the fabric between the electrodes.

18. A heating system according to claim 1, wherein the carbonised heating element has a protective layer on at least one side thereof.

19. A heating system according to claim 18, wherein the carbonised fabric heating element includes a pair of opposite sides and further comprises a pair of protective layers, the protective layers each being applied to a respective one of the opposite sides.

20. A heating system according to claim 17, wherein the protective layers cooperate with at least one edging strip to encapsulate the carbonised fabric heating element.

21. A heating system according to claim 20, wherein said means for applying the potential difference comprise at least two conductive bus bars at least partially encapsulated along with the carbonised fabric heating element by the protective layers.

22. A heating system according to claim 21, wherein said bus bars each comprise at least one of copper, electrically conductive metal foil, woven wire braid, woven wire strips, an electrically conductive plastics material, and conductive wires.

23. A heating system according to claim 22, wherein the bus bars are each at least one of a metal foil and a metal strip and are applied to the carbonised fabric by double sided electrically conductive self-adhesive tape.

24. A heating system according to claim 22, wherein the bus bars each comprise woven wire braid and are connected to the carbonised fabric by means of a carbon laden silicon elastomer.

25. A heating system according to claim 24, wherein the bus bars are each sewn to the carbonised fabric heating element and at

26. A heating system according to claim 19, wherein:

said protective layers each include one of a single layer and multiple layers of at least one of a pvc coating, a thermal polyurethane coating, polyurethane coating nylon lamination, a polyester lamination, nylon/polyester lamination, fibreglass, rubber and plastic mouldings and laminations, closed cell foams, open cell foams, coated foams, uncoated foams, adhesives, adhesive netting, and extrudate.

27. A heating system according to claim 1, wherein the resistance of the carbonised heating element is in the range 1.5 to 4.5 ohms/$m^2$ at 20° C.

28. A heating system according to claim 27, wherein the carbonised fabric heating element is woven and has a resistance in the weft direction of 3.0 to 4.5 ohms/$m^2$ and 1.5 to 2.5 ohms/$m^2$ in the warp direction, at 20° C.

29. A heating system according to claim 1, wherein the carbonised fabric heating element is of an oxidised polyacrilonitrile fibre of finished weight of 240 grammes/$m^2$ nominal of end per cm=12(30 nominal per inch) and 6 per cm=(22 nominal per inch).

30. A heating system according to claim 1, wherein the carbonised fabric heating element is embodied in a vehicle seat.

* * * * *